US009364722B1

(12) United States Patent
Hanna et al.

(10) Patent No.: US 9,364,722 B1
(45) **Date of Patent: *Jun. 14, 2016**

(54) METHOD FOR PRINTING AN IMAGE AT MULTIPLE LOCATIONS ON A GOLF BALL

(71) Applicant: Callaway Golf Company, Carlsbad, CA (US)

(72) Inventors: Ray Hanna, Chicopee, MA (US); Vince Simonds, Brimfield, MA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/066,964

(22) Filed: Mar. 10, 2016

Related U.S. Application Data

(63) Continuation of application No. 14/880,428, filed on Oct. 12, 2015, now Pat. No. 9,283,443.

(60) Provisional application No. 62/063,265, filed on Oct. 13, 2014.

(51) Int. Cl.

| | |
|---|---|
| ***A63B 45/02*** | (2006.01) |
| ***B41F 17/30*** | (2006.01) |
| ***B41M 1/40*** | (2006.01) |
| ***B41F 15/08*** | (2006.01) |
| ***A63B 37/00*** | (2006.01) |
| ***B41F 17/18*** | (2006.01) |
| ***B41F 16/00*** | (2006.01) |
| ***B41F 17/00*** | (2006.01) |

(52) U.S. Cl.

CPC ..... *A63B 45/02* (2013.01); *A63B 37/0022* (2013.01); *B41F 15/089* (2013.01); *B41F 15/0872* (2013.01); *B41F 15/0895* (2013.01); *B41F 16/008* (2013.01); *B41F 17/006* (2013.01); *B41F 17/18* (2013.01); *B41F 17/30* (2013.01); *B41M 1/40* (2013.01)

(58) Field of Classification Search

CPC ..... B41F 15/089; B41F 15/0872; B41F 15/0895; B41F 16/008; B41F 17/06; B41F 17/18; B41F 17/30; B41M 1/40; A63B 37/0022; A63B 45/02

USPC ..... 101/DIG. 4, 35, 41

See application file for complete search history.

(56) References Cited

U.S. PATENT DOCUMENTS

| | | | | |
|---|---|---|---|---|
| 5,778,793 | A * | 7/1998 | Mello | A63B 37/0003 101/32 |
| 6,524,419 | B1 * | 2/2003 | Dabrowski, Jr. | A63B 45/02 156/230 |
| D525,325 | S * | 7/2006 | Hanna, Sr. | D21/714 |
| 7,448,323 | B2 * | 11/2008 | Kennedy, III | A63B 45/02 101/35 |
| 7,765,931 | B2 * | 8/2010 | Kennedy, III | A63B 45/02 101/35 |
| 9,044,650 | B2 * | 6/2015 | Kuntimaddi | B05B 15/045 |
| 9,114,282 | B2 * | 8/2015 | Kennedy, III | B41F 17/30 |
| 2002/0032076 | A1 * | 3/2002 | Isogawa | A63B 37/0003 473/351 |
| 2002/0097280 | A1 * | 7/2002 | Loper | B41J 3/4073 347/2 |
| 2003/0106442 | A1 * | 6/2003 | Gosetti | A63B 45/02 101/35 |
| 2010/0087273 | A1 * | 4/2010 | Matthews | A63B 43/00 473/353 |

* cited by examiner

*Primary Examiner* — Blake A Tankersley
*Assistant Examiner* — Marissa Ferguson Samreth
(74) *Attorney, Agent, or Firm* — Michael Catania; Rebecca Hanovice; Sonia Lari

(57) ABSTRACT

A method for printing an image at multiple positions on a golf ball is disclosed herein. The plurality of locations for the image is preferably ten. The image is preferably a pentagon. The image is alternatively a hexagon or a circle.

10 Claims, 7 Drawing Sheets

METHOD FOR PRINTING AN IMAGE AT MULTIPLE LOCATIONS ON A GOLF BALL

CROSS REFERENCES TO RELATED APPLICATIONS

The Present Application is a continuation of U.S. patent application Ser. No. 14/880,428, filed on Oct. 12, 2015, which claims priority to U.S. Provisional Patent Application No. 62/063,265, filed on Oct. 13, 2014, both of which are hereby incorporated by reference in their entireties.

STATEMENT REGARDING FEDERALLY SPONSORED RESEARCH OR DEVELOPMENT

Not Applicable

BACKGROUND OF THE INVENTION

1. Field of the Invention

The present invention relates to a method for printing an image at multiple locations on a golf ball.

2. Description of the Related Art

The prior art discloses various methods for printing images on a surface of a golf ball.

However, the prior art has failed to disclose a method for printing an image at multiple locations on a golf ball in a cost effective and efficient manner.

BRIEF SUMMARY OF THE INVENTION

The present invention provides a method for printing an image at multiple locations on a golf ball in a cost effective and efficient manner.

One aspect of the present invention is a method for printing an image at multiple locations on a golf ball. The method includes priming a golf ball at a priming station. The golf ball has an exterior surface with an aerodynamic pattern thereon. The method also includes transferring the golf ball to a printing station. The method also includes stamping a plurality of locations of the exterior surface of the golf ball with ultraviolet ink in the form of an image to generate a golf ball with the image at a plurality of locations. The method also includes transferring the golf ball with the image at a plurality of locations to a curing station. The method also includes curing the golf ball with the image at a plurality of locations at the curing station using ultraviolet energy to generate a cured golf ball with the image at a plurality of locations. The method also includes transferring the cured golf ball with the image at a plurality of locations to the printing station. The method also includes stamping ultraviolet ink in the form of the image at a first pole of the golf ball with the image at a plurality of locations to generate a single pole-stamped golf ball. The method also includes transferring the single pole-stamped golf ball to the curing station. The method also includes curing the single pole-stamped golf ball at the curing station using ultraviolet energy to generate a cured single pole-stamped golf ball. The method also includes transferring the cured single pole stamped golf ball to the printing station. The method also includes stamping ultraviolet ink in the form of the image at a second pole of the cured single pole stamped golf ball to generate a dual pole stamped golf ball. The method also includes transferring the dual pole stamped golf ball to the curing station. The method also includes curing the dual pole-stamped golf ball at the curing station using ultraviolet energy to generate a cured dual pole-stamped golf ball. The method also includes transferring the cured dual pole-stamped golf ball to a clear coat station. The method also includes applying a clear coat to the cured dual pole-stamped golf ball to generate a clear coat golf ball. The method also includes transferring the clear coat golf ball to an oven curing station. The method also includes oven-curing the clear coat golf ball at the oven curing station to generate a finished golf ball.

Another aspect of the present invention is a method for printing an image at multiple positions on a golf ball. The method includes priming a golf ball at a priming station. The golf ball has an exterior surface with an aerodynamic pattern thereon. The method also includes transferring the golf ball to a first printing station. The method also includes stamping a plurality of locations of the exterior surface of the golf ball with ultraviolet ink in the form of an image to generate a golf ball with the image at a plurality of locations. The method also includes transferring the golf ball with the image at a plurality of locations to a first curing station. The method also includes curing the golf ball with the image at a plurality of locations at the first curing station using ultraviolet energy to generate a cured golf ball with the image at a plurality of locations. The method also includes transferring the cured golf ball with the image at a plurality of locations to a second printing station. The method also includes stamping ultraviolet ink in the form of the image at a first pole of the golf ball with the image at a plurality of locations to generate a single pole-stamped golf ball. The method also includes transferring the single pole-stamped golf ball to a second curing station. The method also includes curing the single pole-stamped golf ball at the second curing station using ultraviolet energy to generate a cured single pole-stamped golf ball. The method also includes transferring the cured single pole stamped golf ball to a third printing station. The method also includes stamping ultraviolet ink in the form of the image at a second pole of the cured single pole stamped golf ball to generate a dual pole stamped golf ball. The method also includes transferring the dual pole stamped golf ball to a third curing station. The method also includes curing the dual pole-stamped golf ball at the third curing station using ultraviolet energy to generate a cured dual pole-stamped golf ball. The method also includes transferring the cured dual pole-stamped golf ball to a clear coat station. The method also includes applying a clear coat to the cured dual pole-stamped golf ball to generate a clear coat golf ball. The method also includes transferring the clear coat golf ball to an oven curing station. The method also includes oven-curing the clear coat golf ball at the oven curing station to generate a finished golf ball.

Yet another aspect of the present invention is a method for printing an image at multiple locations on a golf ball. The method includes stamping an exterior surface of a golf ball with a first plurality of images to create a stamped golf ball. The method also includes curing the stamped golf ball. The method also includes stamping a first pole of the exterior surface of the stamped golf ball with an image to create a single pole stamped golf ball. The method also includes curing the single pole stamped golf ball. The method also includes stamping a second pole of the exterior surface of the stamped golf ball with an image to create a dual pole stamped golf ball. The method also includes curing the dual pole stamped golf ball to create a finished golf ball.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
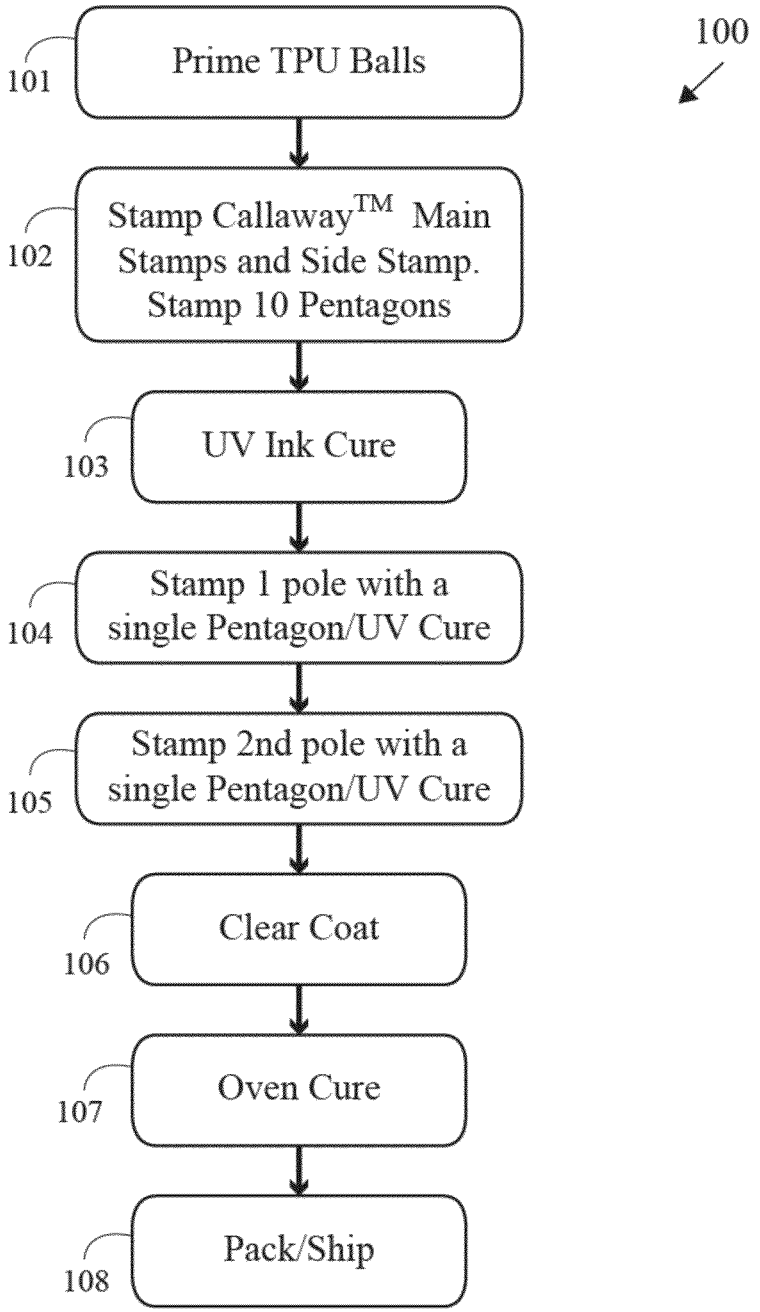
FIG. 1 is a flow chart of a method for printing an image at multiple locations on a golf ball.
Figure 2:
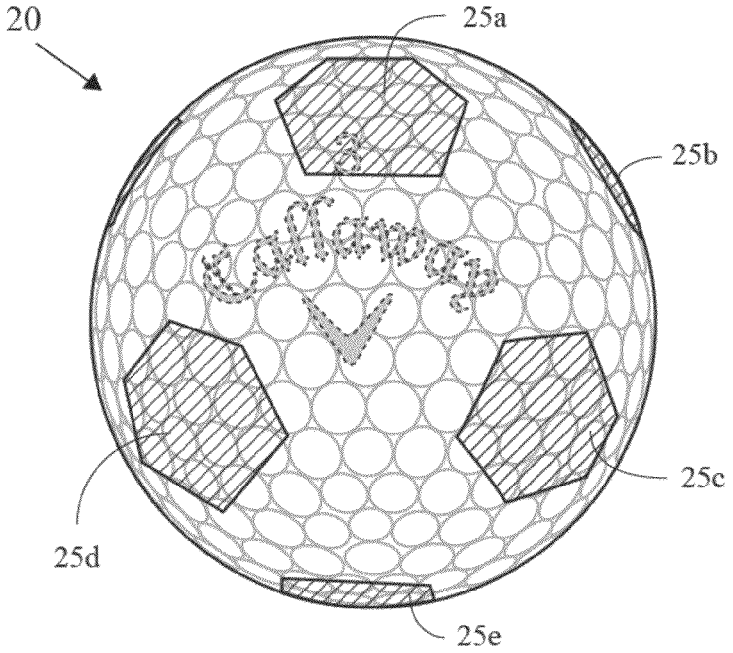
FIG. 2 is a perspective view of a golf ball with hexagon images printed thereon.
Figure 3:
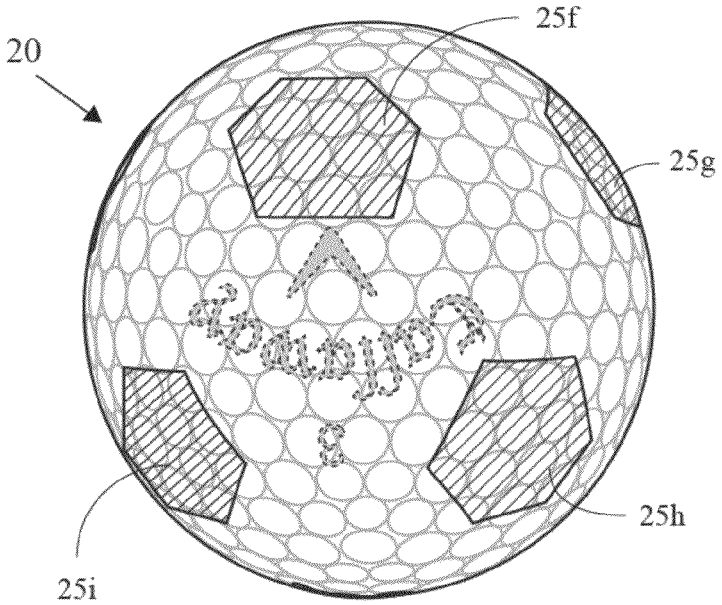
FIG. 3 is a perspective view of a golf ball with hexagon images printed thereon.
Figure 4:
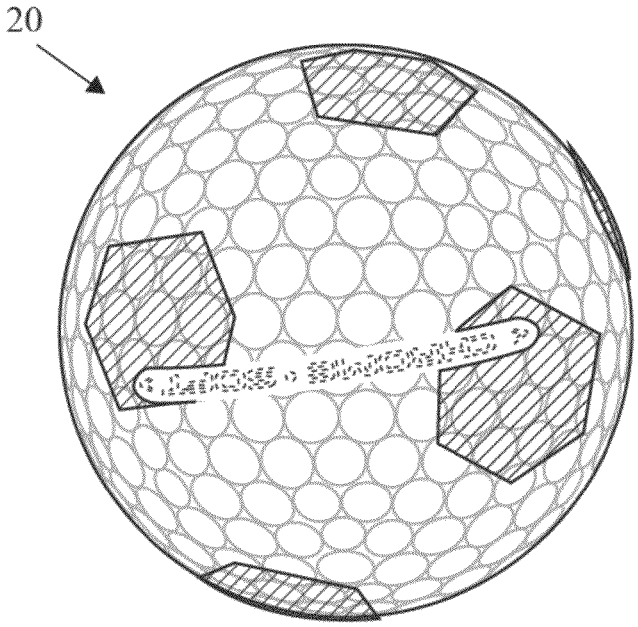
FIG. 4 is a perspective view of a golf ball with hexagon images printed thereon.
Figure 5:
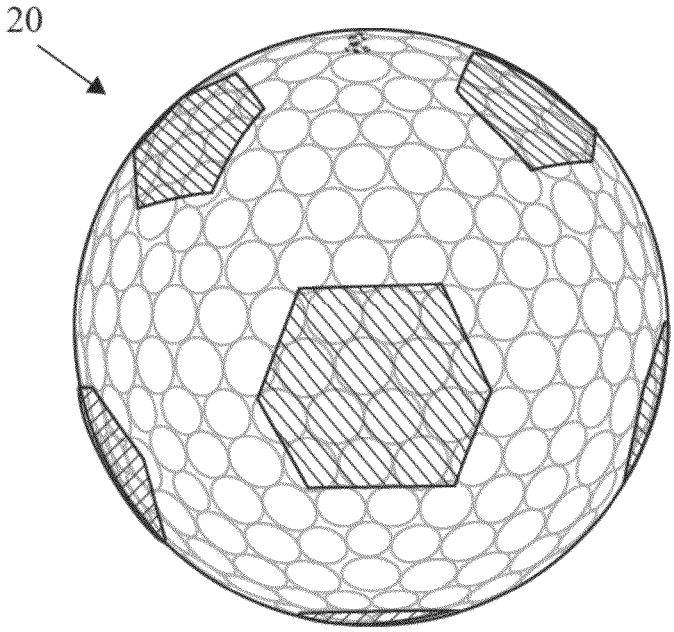
FIG. 5 is a perspective view of a golf ball with hexagon images printed thereon.
Figure 6:
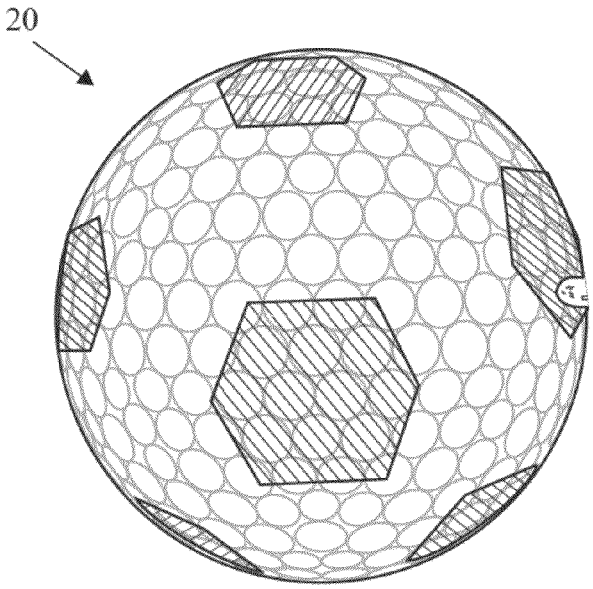
FIG. 6 is a perspective view of a golf ball with hexagon images printed thereon.
Figure 7:
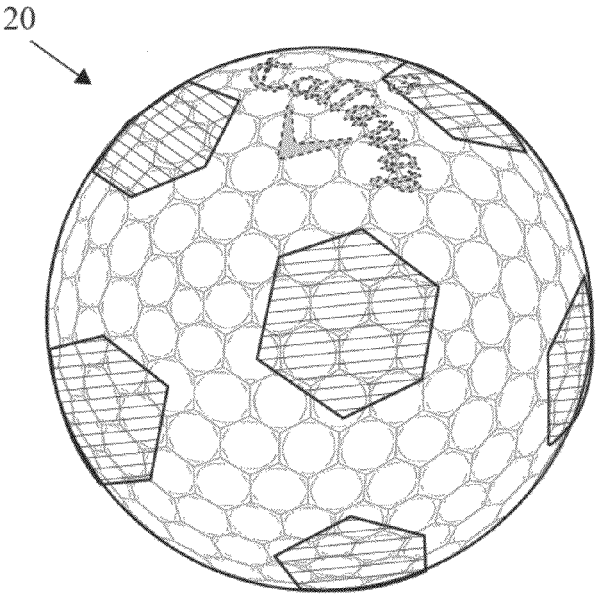
FIG. 7 is a perspective view of a golf ball with hexagon images printed thereon.
Figure 8:
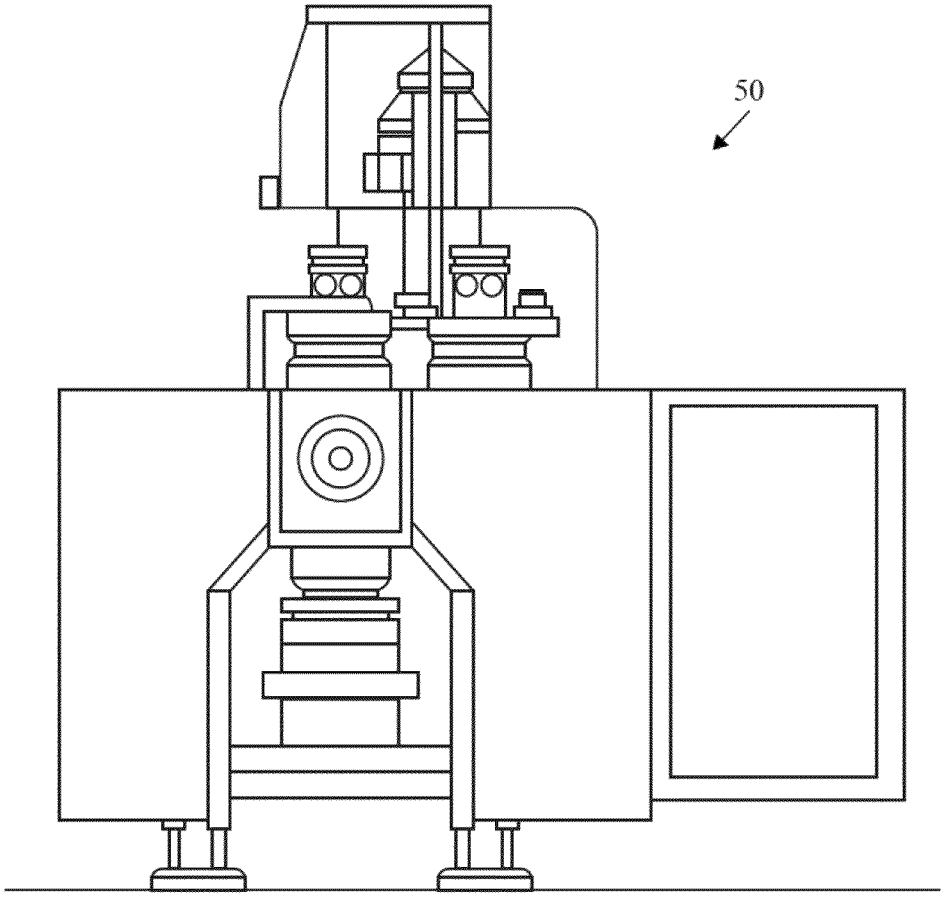
FIG. 8 is a front elevation view of a printing apparatus.

A flow chart of a method 100 for printing an image at multiple locations on a golf ball is shown in FIG. 1. At block 101, a golf ball is primed at a priming station. The golf ball has an exterior surface with an aerodynamic pattern thereon. At block 102, the golf ball is stamped with a logo, a side stamp and images at various locations. At block 103, the golf ball with the image at multiple locations is cured at the curing station using ultraviolet energy to generate a cured golf ball with the image at multiple locations. At block 104, ultraviolet ink in the form of the image is stamped at a first pole of the golf ball with the image at multiple locations to generate a single pole-stamped golf ball, and the single pole-stamped golf ball is cured at the curing station using ultraviolet energy to generate a cured single pole-stamped golf ball. At block 105, ultraviolet ink in the form of the image is stamped at a second pole of the cured single pole stamped golf ball to generate a dual pole stamped golf ball, and the dual pole-stamped golf ball is cured at the curing station using ultraviolet energy to generate a cured dual pole-stamped golf ball. At block 106, a clear coat is applied to the cured dual pole-stamped golf ball to generate a clear coat golf ball. At block 107, the clear coat golf ball is cured at the oven curing station to generate a finished golf ball. At block 108, the golf ball is packed and shipped.

FIGS. 2-7 illustrate golf balls with images 25 that are printed on the golf ball 20.

Another pattern utilized is set forth in Stahl et al., U.S. Pat. No. D410511 for a Golf Ball With A Pentagon Shaped Pattern which is hereby incorporated by reference in its entirety. Another pattern utilized is set forth in Stahl et al., U.S. Pat. No. D410979 for a Golf Ball With A Pentagon Shaped Pattern which is hereby incorporated by reference in its entirety. Another pattern utilized is set forth in Stahl et al., U.S. Pat. No. D412954 for a Golf Ball With A Spiral Pattern which is hereby incorporated by reference in its entirety. Another pattern utilized is set forth in Stahl et al., U.S. Pat. No. D415541 for a Golf Ball With A Ring Pattern which is hereby incorporated by reference in its entirety. Another pattern utilized is set forth in Stahl et al., U.S. Pat. No. D419626 for a Golf Ball With A Contour-Shaped Pattern which is hereby incorporated by reference in its entirety. Another pattern utilized is set forth in Stahl et al., U.S. Pat. No. D424143 for a Golf Ball With A Star-Shaped Pattern which is hereby incorporated by reference in its entirety.

One construction of a golf ball utilized with the present invention is disclosed in Ogg et al., U.S. Pat. No. 8,651,976 for a Multiple Layer Golf Ball, which is hereby incorporated by reference in its entirety. Another construction of a golf ball utilized with the present invention is disclosed in Ogg et al., U.S. Pat. No. 8,475,298 for a Golf Ball Having Dual Core Deflection Differential, which is hereby incorporated by reference in its entirety.

Components of current golf ball painting systems may be employed with the present invention, and an example of such components are disclosed Skrabski et al., U.S. Pat. No. 6,544,337 for a Golf Ball Painting System, which is hereby incorporated by reference in its entirety.

In a particularly preferred embodiment of the invention, the golf ball preferably has an aerodynamic pattern such as disclosed in Simonds et al., U.S. Pat. No. 7,419,443 for a Low Volume Cover For A Golf Ball, which is hereby incorporated by reference in its entirety. Alternatively, the golf ball has an aerodynamic pattern such as disclosed in Simonds et al., U.S. Pat. No. 7,338,392 for An Aerodynamic Surface Geometry For A Golf Ball, which is hereby incorporated by reference in its entirety. Alternatively, the golf ball has an aerodynamic pattern such as disclosed in Ogg, U.S. Pat. No. 6,551,203 for A Golf Ball With Multiple Sets Of Dimples, which is hereby incorporated by reference in its entirety.

In a preferred embodiment, the cover is preferably composed of a thermoplastic polyurethane material, and preferably has a thickness ranging from 0.025 inch to 0.04 inch, and more preferably ranging from 0.03 inch to 0.04 inch. The material of the cover preferably has a Shore D plaque hardness ranging from 30 to 60, and more preferably from 40 to 50. The Shore D hardness measured on the cover is preferably less than 56 Shore D. Preferably the cover 16 has a Shore A hardness of less than 96. Alternatively, the cover 16 is composed of a thermoplastic polyurethane/polyurea material. One example is disclosed in U.S. Pat. No. 7,367,903 for a Golf Ball, which is hereby incorporated by reference in its entirety. Another example is Melanson, U.S. Pat. No. 7,641,841, which is hereby incorporated by reference in its entirety. Another example is Melanson et al, U.S. Pat. No. 7,842,211, which is hereby incorporated by reference in its entirety. Another example is Matroni et al., U.S. Pat. No. 7,867,111, which is hereby incorporated by reference in its entirety. Another example is Dewanjee et al., U.S. Pat. No. 7,785,522, which is hereby incorporated by reference in its entirety.

A discussion of the USGA initial velocity test is disclosed in Yagley et al., U.S. Pat. No. 6,595,872 for a Golf Ball With High Coefficient Of Restitution, which is hereby incorporated by reference in its entirety. Another example is Bartels et al., U.S. Pat. No. 6,648,775 for a Golf Ball With High Coefficient Of Restitution, which is hereby incorporated by reference in its entirety.

Figure 9:
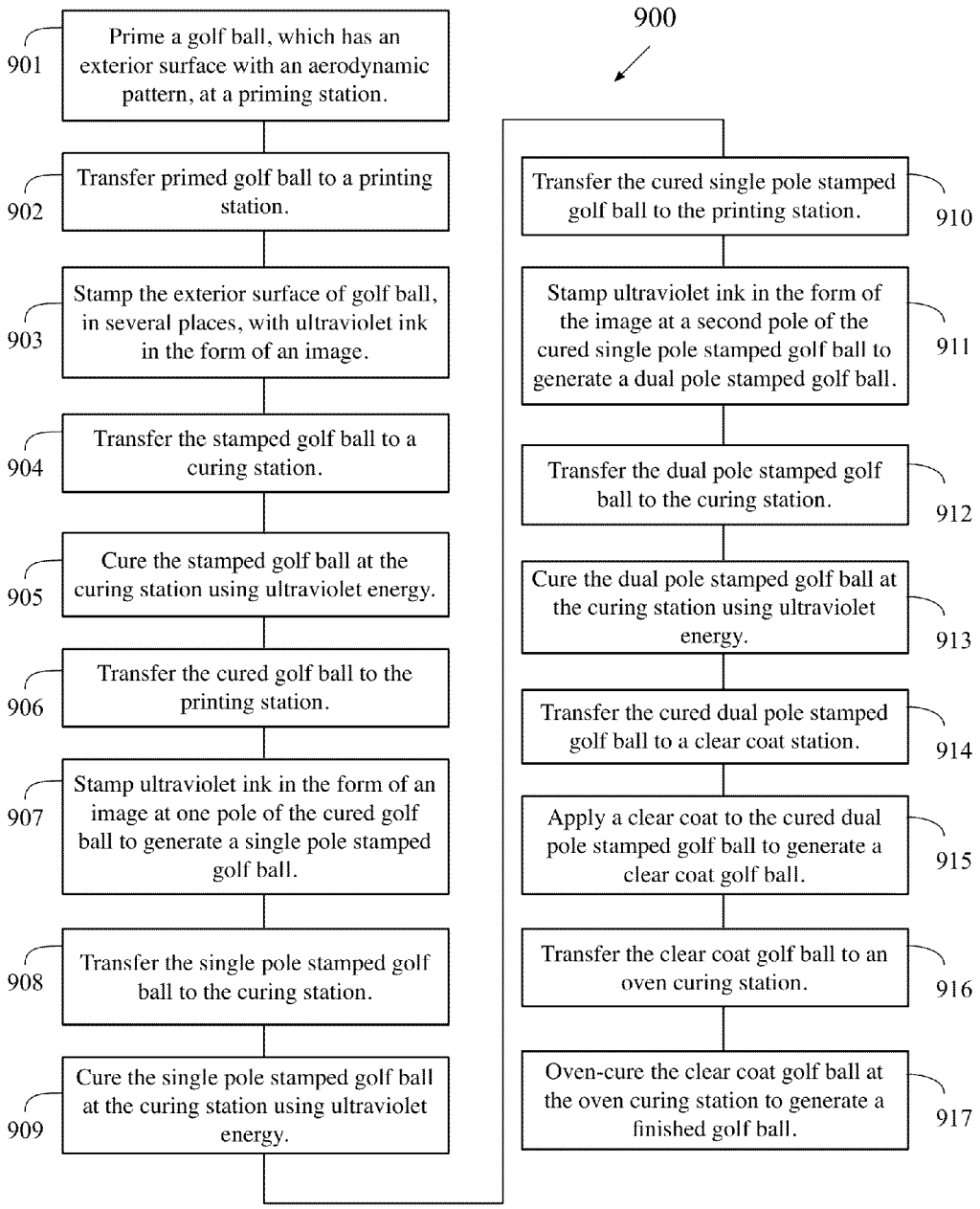
FIG. 9 is a flow chart of a preferred method for printing an image at multiple locations on a golf ball.

A flow chart of a preferred method 900 for printing an image at multiple locations on a golf ball is shown in FIG. 9. At block 901, a golf ball is primed at a priming station. The golf ball has an exterior surface with an aerodynamic pattern thereon. At block 902, the golf ball is transferred to a printing station. At block 903, multiple locations of the exterior surface of the golf ball are stamped with ultraviolet ink in the form of an image to generate a golf ball with the image at multiple locations. At block 904, the golf ball with the image at multiple locations is transferred to a curing station. At block 905, the golf ball with the image at a plurality of locations is cured at the curing station using ultraviolet energy to generate a cured golf ball with the image at multiple locations. At block 906, the cured golf ball with the image at multiple locations is transferred to the printing station. At block 907, ultraviolet ink in the form of the image is stamped at a first pole of the golf ball with the image at multiple locations to generate a single pole-stamped golf ball. At block 908, the single pole-stamped golf ball is transferred to the curing station. At block 909, the single pole-stamped golf ball is cured at the curing station using ultraviolet energy to generate a cured single pole-stamped golf ball. At block 910, the cured single pole stamped golf ball is transferred to the printing station. At block 911, ultraviolet ink in the form of the image is stamped at a second pole of the cured single pole stamped golf ball to generate a dual pole stamped golf ball. At block 912, the dual pole stamped golf ball is transferred to the curing station. At block 913, the dual pole-stamped golf ball is cured at the curing station using ultraviolet energy to generate a cured dual pole-stamped golf ball. At block 914, the cured dual pole-stamped golf ball is transferred to a clear coat station. At block 915, a clear coat is applied to the cured dual pole-stamped golf ball to generate a clear coat golf ball. At block 916, the clear coat golf ball is transferred to an oven curing station. At block 917, the clear coat golf ball is cured at the oven curing station to generate a finished golf ball.

Figure 9A:
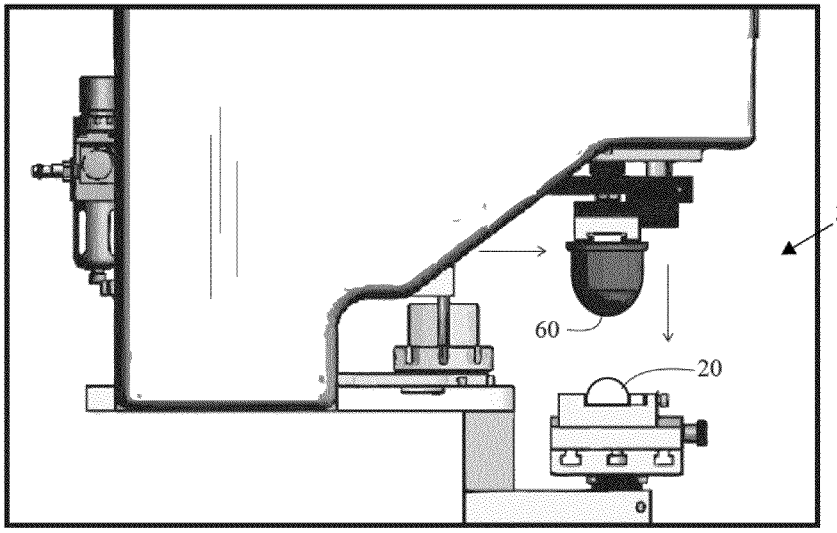
FIG. 9A is an isolated view of a stamping station of the printing apparatus at a first time period.
Figure 9B:
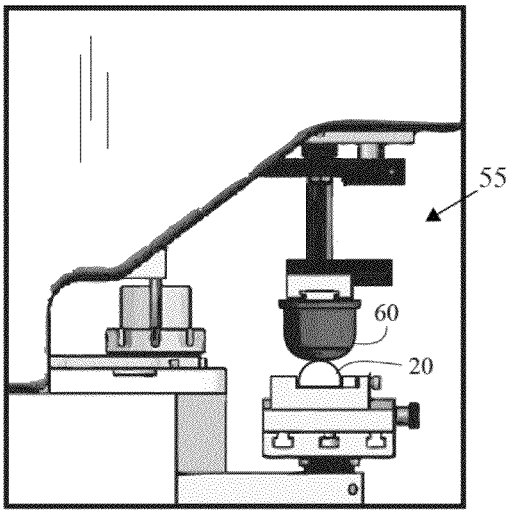
FIG. 9B is an isolated view of a stamping station of the printing apparatus at a second time period.
Figure 9C:
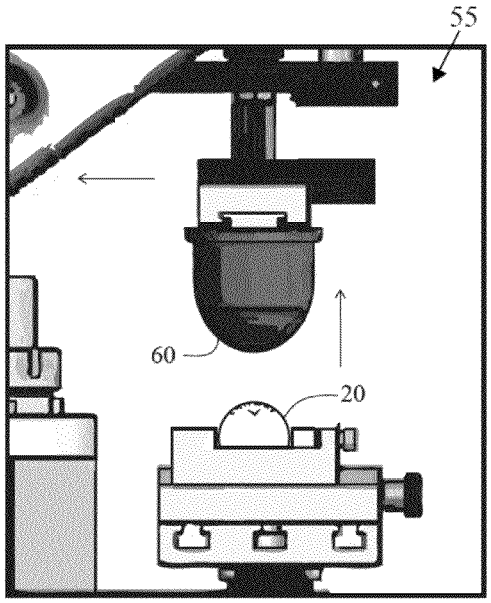
FIG. 9C is an isolated view of a stamping station of the printing apparatus at a third time period.

FIGS. 9A, 9B and 9C illustrate on embodiment of a stamping process at a stamping station 55. A stamp device 60 stamps a golf ball 20 at the stamping station 55.

The image is preferably blue, red, orange, green or purple in color. The plurality of locations for the image is preferably ten. The image is preferably a pentagon. The image is alternatively a hexagon or a circle.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A method for printing an image at multiple locations on a golf ball, the method comprising:

stamping a plurality of locations of an exterior surface of a golf ball with ink in the form of an image to generate a golf ball with the image at a plurality of locations at a printing station;

transferring the golf ball with the image at the plurality of locations to a curing station;

curing the golf ball with the image at a plurality of locations at the curing station to generate a cured golf ball with the image at a plurality of locations;

transferring the cured golf ball with the image at a plurality of locations to the printing station;

stamping ink in the form of the image at a pole of the golf ball with the image at a plurality of locations to generate a pole-stamped golf ball;

transferring the pole-stamped golf ball to the curing station;

curing the pole-stamped golf ball at the curing station to generate a cured pole-stamped golf ball; and finishing the cured pole-stamped golf ball.

2. The method according to claim 1 wherein finishing the pole-stamped golf ball comprises:

transferring the cured pole-stamped golf ball to a clear coat station;

applying a clear coat to the cured pole-stamped golf ball to generate a clear coat golf ball;

transferring the clear coat golf ball to an oven curing station; and curing the clear coat golf ball at the oven curing station to generate a finished golf ball.

3. The method according to claim 1 wherein the plurality of locations is ten.

4. The method according to claim 1 wherein the image is a pentagon.

5. The method according to claim 1 wherein the image is a hexagon.

6. The method according to claim 1 wherein the image is a circle.

7. The method according to claim 1 wherein the golf ball has a thermoplastic polyurethane cover.

8. The method according to claim 1 wherein the golf ball has an ionomer cover.

9. The method according to claim 1 wherein the golf ball has multiple layers.

10. The method according to claim 1 wherein the image is the color blue, red, orange, green or purple.

* * * * *